US007946096B2

(12) United States Patent
Murarotto

(10) Patent No.: US 7,946,096 B2
(45) Date of Patent: May 24, 2011

(54) SYSTEM FOR WRAPPING LOADS

(75) Inventor: Emilio Murarotto, Castelfranco Veneto (IT)

(73) Assignee: BEMA S.r.l., Viano (IT)

( * ) Notice: Subject to any disclaimer, the term of this patent is extended or adjusted under 35 U.S.C. 154(b) by 150 days.

(21) Appl. No.: 12/309,482

(22) PCT Filed: Feb. 20, 2007

(86) PCT No.: PCT/IB2007/000409

§ 371 (c)(1),
(2), (4) Date: Feb. 5, 2009

(87) PCT Pub. No.: WO2008/012610

PCT Pub. Date: Jan. 31, 2008

(65) Prior Publication Data

US 2009/0313942 A1 Dec. 24, 2009

(30) Foreign Application Priority Data

Jul. 20, 2006 (EP) ..... 06425501

(51) Int. Cl.
*B65B 11/04* (2006.01)

(52) U.S. Cl. ..... 53/168; 53/556; 53/582; 53/389.2

(58) Field of Classification Search ..... 53/168, 53/556, 582, 587, 588, 203, 210, 211, 389.2
See application file for complete search history.

(56) References Cited

U.S. PATENT DOCUMENTS

| | | | | |
|---|---|---|---|---|
| 4,095,395 | A | 6/1978 | Goldstein | |
| 4,497,159 | A * | 2/1985 | Lancaster, III | 53/556 |
| 4,722,170 | A | 2/1988 | Ball et al. | |
| 4,938,008 | A * | 7/1990 | Salzsauler | 53/556 |
| 5,450,711 | A * | 9/1995 | Martin-Cocher | 53/556 |
| 5,463,842 | A * | 11/1995 | Lancaster | 53/556 |
| 6,185,914 | B1 * | 2/2001 | Mackie | 53/556 |
| 6,311,459 | B1 * | 11/2001 | Rossi | 53/389.2 |
| 6,324,820 | B1 * | 12/2001 | Gelfman et al. | 53/588 |
| 6,393,808 | B1 * | 5/2002 | Kallner et al. | 53/556 |
| 6,772,573 | B2 * | 8/2004 | Federeszyn | 53/389.2 |
| 2003/0093973 | A1 * | 5/2003 | Mir | 53/556 |
| 2004/0163364 | A1 * | 8/2004 | Cousins et al. | 53/556 |
| 2007/0169442 | A1 * | 7/2007 | Asioli | 53/588 |

FOREIGN PATENT DOCUMENTS

| | | | |
|---|---|---|---|
| DE | 2810124 | | 9/1978 |
| JP | 05221409 | A * | 8/1993 |

* cited by examiner

*Primary Examiner* — Stephen F Gerrity
(74) *Attorney, Agent, or Firm* — Dykema Gossett PLLC

(57) ABSTRACT

A system for wrapping loads includes a moving machine and a wrapping head equipped with a reel of film for covering a load, the wrapping head including sleeves which can be positioned on pegs of an external supporting frame for parking the head in a store, and blocks with slots in which pins of the moving machine can be vertically inserted to lift and move the wrapping head.

18 Claims, 4 Drawing Sheets

SYSTEM FOR WRAPPING LOADS

TECHNICAL FIELD

This invention refers to a system for wrapping loads, in particular palletised loads that consist of one or more products distributed more or less evenly on a pallet so it can be handled and transported practically and easily.

BACKGROUND ART

As is common knowledge, palletised loads are normally covered with a stabilising covering that immobilises them on the pallet so they can then be transported without risk of falling or tipping over.

To make such a stabilising covering the usual way is to tightly wrap the sides of the load and pallet with a plastic covering film that is unwound from a reel of film.

Either automatic or semi automatic systems are normally used for such wrapping.

One very widely used wrapping system uses a machine to move a wrapping head equipped with a reel of covering film.

The moving machine is normally composed of a jointed robot arm that, to wind the covering film around the load to wrap, operates the wrapping head with a lifting and rotating motion around the load to wrap which substantially stays still.

Alternatively, the moving machine works by moving the wrapping head vertically, simultaneously winding the covering film around the palletised load that turns on a rotating platform.

It is also common practice to equip traditional type systems with an automatic wrapping head change unit that deposits the head in a store when the reel of covering film is finished and collects a new head ready to use.

When parking them in the store, the wrapping heads are usually placed on an external frame fitted with pins on which the wrapping head is hung waiting to be used.

For the moving machine to collect them, the wrapping heads are fitted with special coupling means that consist of a circular plate with radial hollows that can be engaged by a mobile wedge system mounted on the robot arm and operated by one or more pneumatic cylinders, also mounted on the robot arm. Once the wrapping head is associated to the robot arm, it is connected to an electrical joint and to a pneumatic feeding joint that lets it work in the palletised load wrapping phase.

These traditional wrapping systems do have a few drawbacks involving the automatic change unit which they are equipped with.

As a matter of fact the use of the mobile wedge system significantly complicates both the structure and the functionality of the moving machines.

In fact, the movability of the wedges must be inconveniently guaranteed by means of a complex electronic system that manages and controls operation of the pneumatic cylinders and of the compressed air unit that feeds them.

Neither must we neglect the fact that the automatic change unit, as it is made, is rather cumbersome and costly.

DISCLOSURE OF THE INVENTION

The main aim of this invention is to devise a system for wrapping loads that will solve the above mentioned problems of the known technology, while making it possible to change the wrapping heads practically and easily in a simple, rational and economical way.

The purposes listed above are all reached with this system for wrappings loads comprising at least one moving machine of at least one wrapping head equipped with at least one reel of film for covering the load, said wrapping head comprising first removable coupling means to an external supporting frame for parking the head in a store and second removable coupling means to said moving machine, characterised by the fact that said second coupling means comprise at least one substantially vertical fastening element associated to at least one between said wrapping head and said moving machine and at least one reference element associated to the other between said wrapping head and said moving machine and which can be coupled to said fastening element along a mutual and substantially vertical direction of engagement and disengagement.

BRIEF DESCRIPTION OF THE DRAWINGS

Further characteristics and advantages of this invention will appear even more evident from the detailed description of a preferred, but not exclusive, form of embodiment of a system for wrapping loads, illustrated by way of non limiting example in the accompanying drawings, wherein.

WAYS OF CARRYING OUT THE INVENTION

Figure 1:
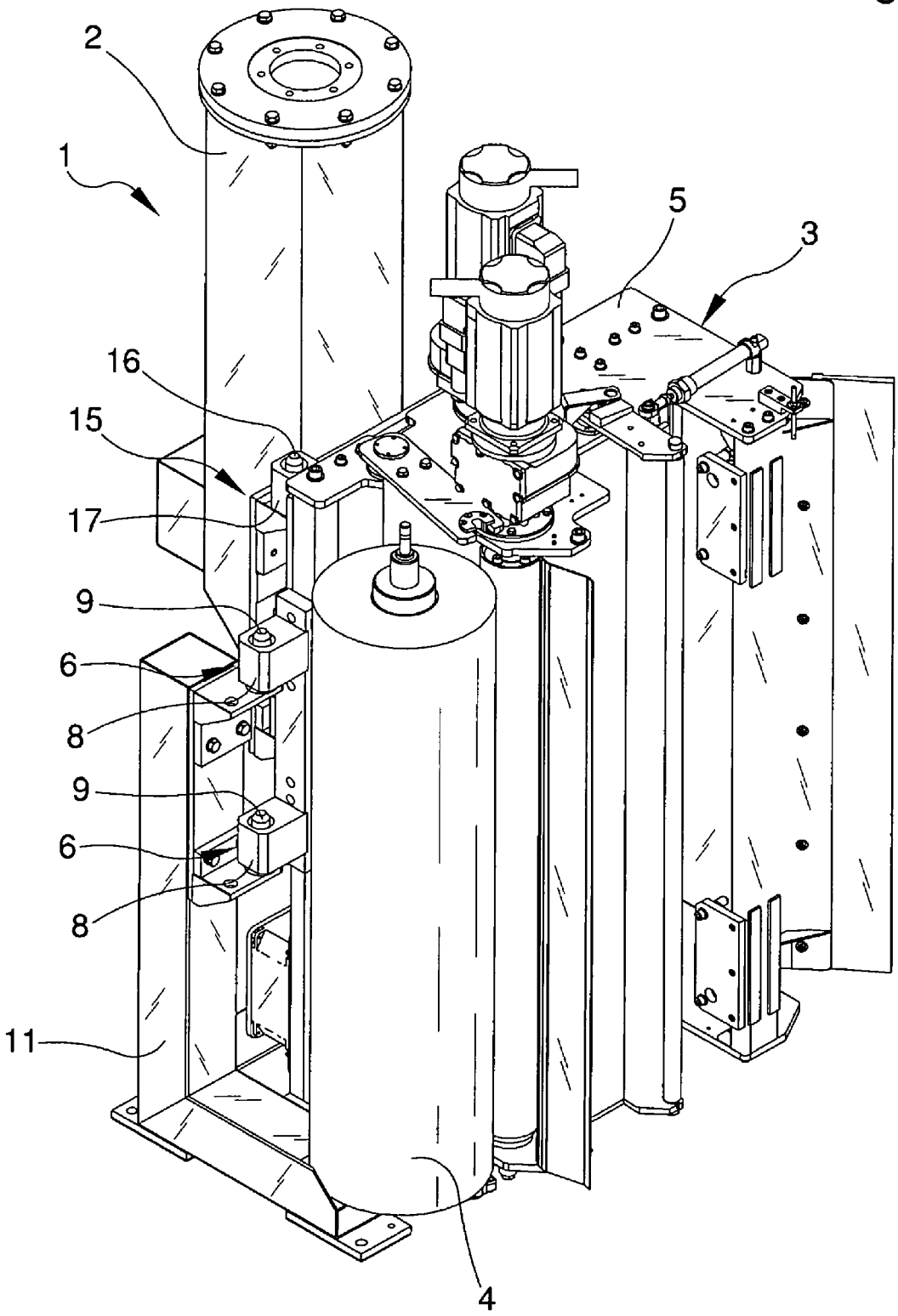
FIG. 1 is an axonometric view of a portion of the system according to the invention during the wrapping head change phase.
Figure 2:
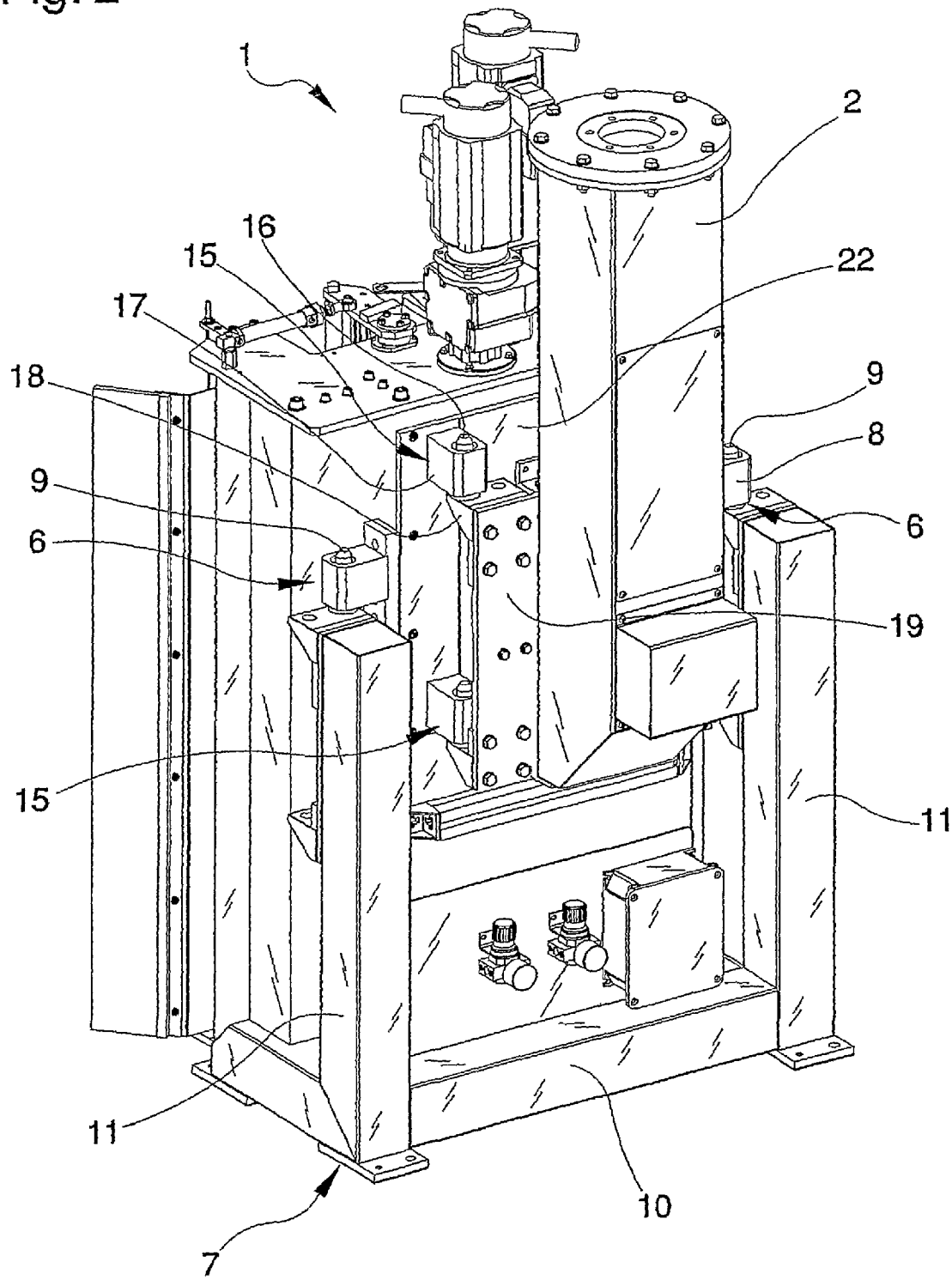
FIG. 2 is an axonometric view, from another angle, of the system of FIG. 1.
Figure 4:
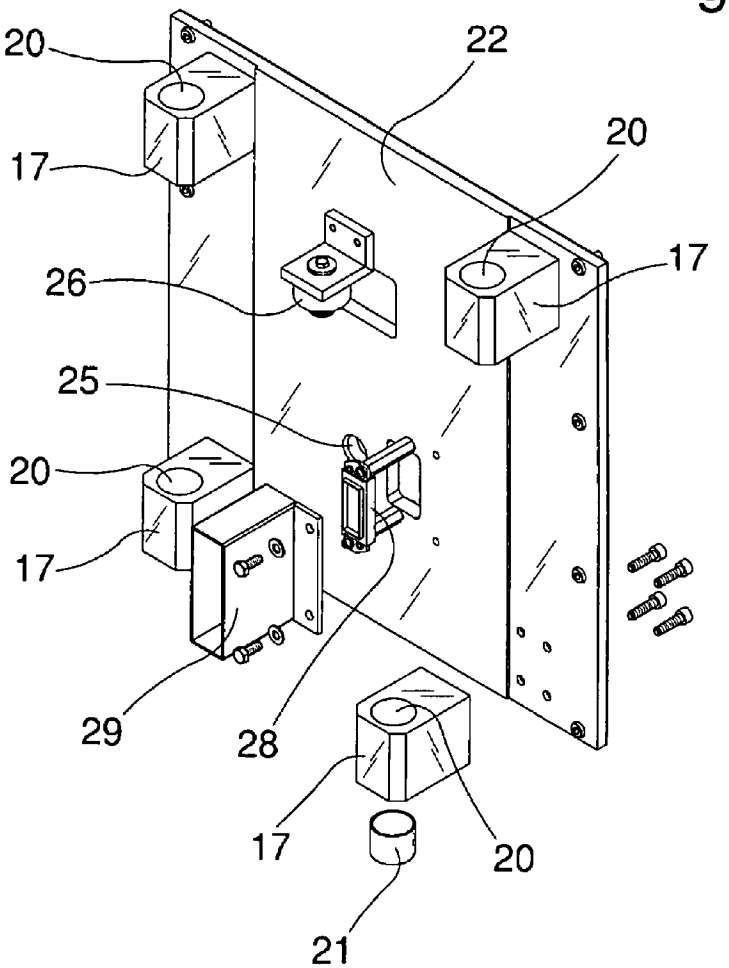
FIG. 4 is an exploded view of the plate for connecting the wrapping head to the moving machine of the system according to the invention.
Figure 3:
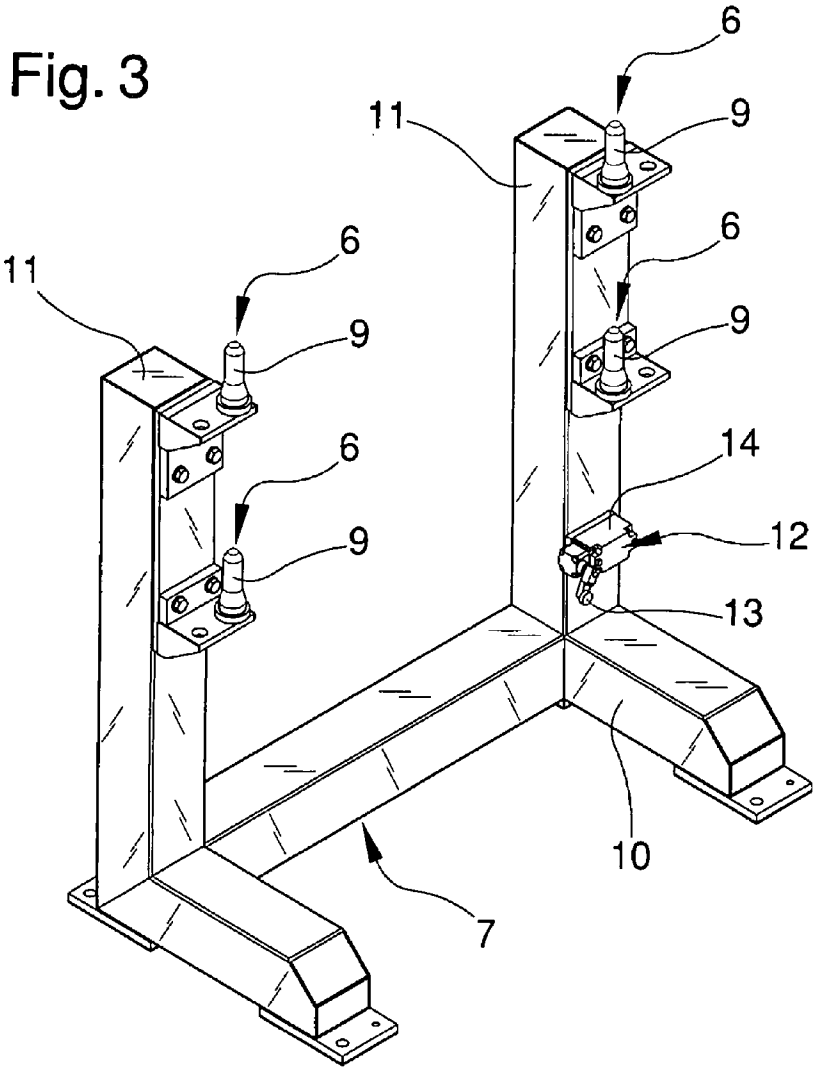
FIG. 3 is an axonometric view of the external frame for supporting the wrapping head in the store contemplated by the system according to the invention.
Figure 5:
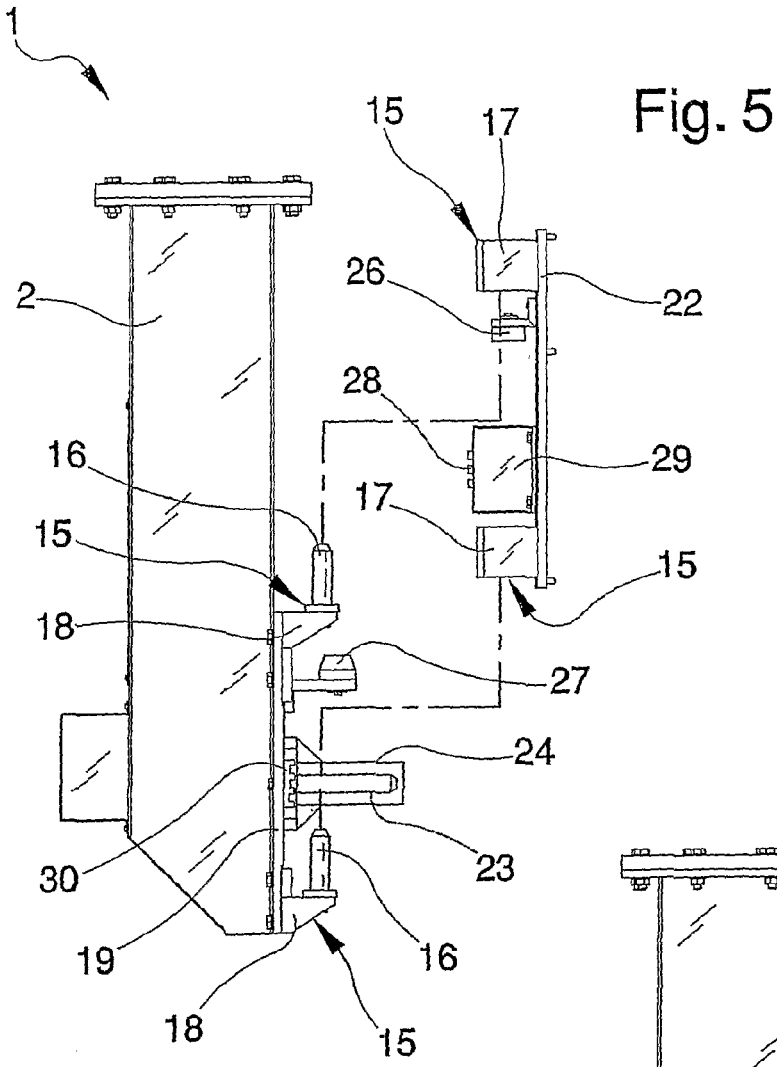
FIG. 5 is an elevated side view of a portion of the moving machine and plate for connecting the wrapping head before mutual coupling.
Figure 6:
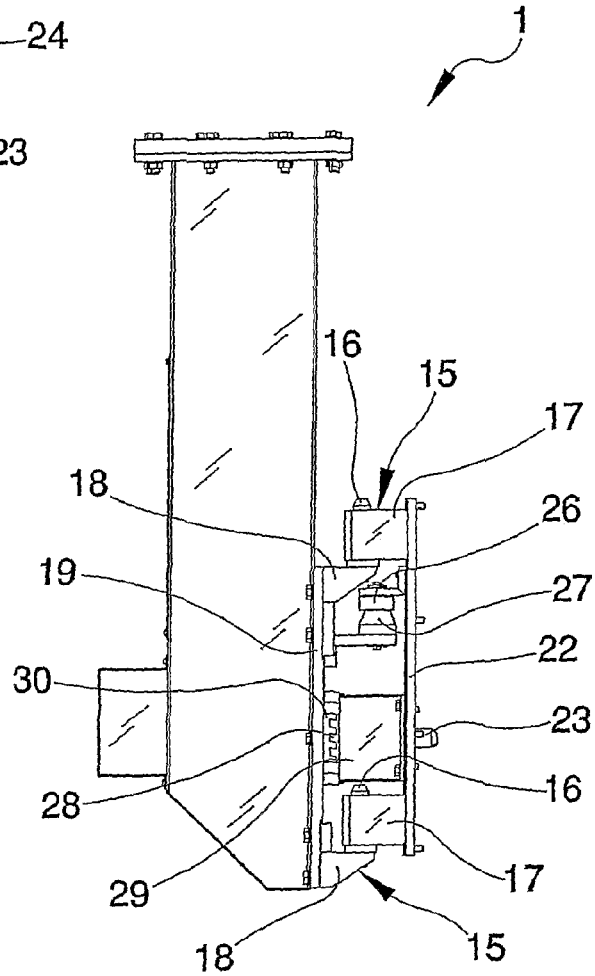
FIG. 6 is an elevated side view of the portion of the moving machine and connecting plate of FIG. 5 in coupling configuration.

With special reference to such figures, a system for wrapping loads, of the palletised type or the like, has been generally designated by reference numeral 1.

The system 1 comprises a moving machine 2 for one wrapping head 3 fitted with a reel 4 of film for covering a load; the load is not illustrated in the figures. Advantageously, the moving machine 2 is composed of a jointed robot arm, of which only the free end is shown in the figures, used to grip the wrapping head 3.

In detail, the wrapping head 3 comprises a boxed body 5 that contains the means to rotate the reel 4, to prestretch the covering film and to wrap it around the load, all of types already known.

The boxed body 5 has a front part which, when used, faces the load to wrap, and a rear part that is fitted with first removable coupling means 6 to an external supporting frame 7 for parking the wrapping head 3 in the store.

The first removable coupling means 6, in particular, consist of four vertical axis sleeves 8 which are distributed at the back of the wrapping head 3 and which are able to engage, substantially without play or interference, the same number of vertical pegs 9 arranged on the external frame 7.

The external frame 7 consists of a beamed structure defining a stand 10 on the floor from which two uprights 11 project upwards, each supporting a pair of vertical pegs 9.

The external frame 7 also comprises means for detecting 12 the wrapping head 3 in the store.

The means for detecting 12 are made up of, for example, a feeler element 13 mounted in a turnable way at the base of one of the uprights 11; when the wrapping head 3 is placed on the external frame 7, the feeler element 13 is pushed downwards contracting a return spring and activating an electronic transducer 14 to which it is associated.

Usefully the wrapping head 3 is equipped with second removable coupling means 15 to the moving machine 2.

The second removable coupling means 15 comprise a plurality of fastening elements 16 substantially extending in a vertical direction from the robot arm 2, and a plurality of reference elements 17 associated to the wrapping head 3 which can be coupled to the fastening elements 16 along a mutual and substantially vertical direction of engagement and disengagement.

The fastening elements 16 and reference elements 17 are integrally and rigidly associated to the moving machine 2 and wrapping head 3 respectively.

In particular, the fastening elements 16 consist of four vertical pins mounted on the same number of associated brackets 18 where the four vertices of a quadrangular (square) plate 19 are.

In turn, the plate 19 is associated vertically to the free end of the robot arm 2.

The reference elements 17 consist of four blocks with corresponding vertical slots 20 that house the same number of anti-wear bushes 21, made in a polymer material, for the insertion without play and interference of the pins 16.

The blocks 17 are mounted on the four vertices of a quadrangular sheet 22 associated vertically to the rear portion of the boxed body 5.

According to the particular form of embodiment of the invention illustrated in the figures, the pins 16 are mounted on the moving machine 2 so they project upwards and can be inserted from the bottom into the blocks 17 associated to the wrapping head 3 and, in use, sustain the weight of the wrapping head 3. Alternative forms of embodiment of this invention are not excluded where, instead, the fastening elements 16 are associated to the wrapping head 3 projecting downwards and, in use, are hung inside the blocks 17 mounted on the free end of the robot arm 2; note that in this case too, coupling between the pins 16 and the blocks 17 and the consequent collection of the wrapping head 3 are done by raising the robot arm 2 from the floor upwards.

The second removable coupling means 15 also comprise holding means 23 that prevent the pins 16 and blocks 17 from sliding once they are connected together.

Such holding means consist of a bar associated to the moving machine 2 sliding along a direction transversal to the pins 16 and plate 19.

In detail, the bar 23 is housed inside a tubular section 24 extending orthogonally from the plate 19 and from where it can be extracted to be inserted in a corresponding through hole 25 made roughly in the middle of the sheet 22.

Usefully, pneumatic connection means and electronic connection means are contemplated, that can be inserted between the wrapping head 3 and the moving machine 2, their purpose being to feed the means housed inside the boxed body 5 with compressed air and electricity to operate the wrapping head 3.

In detail, the pneumatic connection means comprise an first joint 26 projecting from the sheet 22 above the hole 25 and facing down, and a second joint 27 associated to the plate 19 and facing up.

The two joints 26 and 27, in effect, can be coupled one against the other when the wrapping head 3 is mounted on the moving machine 2.

The above mentioned electronic connection means consist of a first electronic port 28, mounted so it projects from the sheet 22 on a supporting and protection column 29 positioned by the side of the hole 25, and a second electronic port 30, associated to the plate 19 and which, when the wrapping head 3 is being mounted on the moving machine 2, can be electrically connected to the first electronic port 28.

The operation of this invention is the following.

When the wrapping head 3 is left in the store, it rests on the external frame 7 by coupling the sleeves 8 with the vertical pegs 9.

To mount the wrapping head 3 on the moving machine 2, the plate 19 is brought up to the sheet 22 so the pins 16 are below the blocks 17, perfectly aligned with the vertical slots 20.

The free end of the robot arm 2 is now lifted so the pins 16 can be introduced into the vertical slots 20 and the wrapping head 3 is positioned against the robot arm 2.

Note that when aligning the pins 16 and the vertical slots 20, joints 26 and 27 are one under the other and coupled together when the robot arm 2 is raised.

The same happens also for the reciprocal connection of the electronic ports 28 and 30.

Moreover at the end of assembly the tubular section 24 is perfectly aligned with the hole 25; when the bar 23 comes out of the tubular section 24 and fits into the hole 25, it prevents the pins 16 from coming out of the blocks 17, making it possible to stabilise the join between the wrapping head 3 and the free end of the robot arm 2.

It has in fact been ascertained how the described invention achieves the set purposes.

The invention thus conceived is susceptible of numerous modifications and variations, all of which falling within the scope of the inventive concept.

Furthermore all the details can be replaced with others that are technically equivalent.

In practice, the materials used, as well as the shapes and dimensions, may be any according to requirements without because of this moving outside the protection scope of the following claims.

The invention claimed is:

1. An apparatus for wrapping loads which comprises:

a support frame which includes first support means for supporting a wrapping head;

a moving means which includes second support means for supporting the wrapping head; and a wrapping head which includes a reel of film for wrapping a load, third support means for engagement with said first support means when said wrapping head is mounted on said support frame, and fourth support means for enagement with said second support means when said wrapping head is connected to said moving means, said second and fourth support means being engageable and disengageable by relative movement in a vertical direction.

2. The system according to claim 1, wherein one of said second and fourth support means comprises a substantially vertical pin and a second of said second and fourth support means comprises a block with a substantially vertical slot for said pin.

3. The system according to claim 2, wherein said second support means comprises said substantially vertical pin and said fourth support means comprises said block.

4. The system according to claim 3, wherein said second support means comprises a quadrangular plate which supports said pin.

5. The system according to claim 4, wherein said second support means comprises a plurality of substantially vertical pins.

6. The system according to claim 5, wherein said second support means comprises four substantially vertical pins located at vertices of said quadrangular plate.

7. The system according to claim 3, wherein said fourth support means comprises a quadrangular sheet which supports said block.

8. The system according to claim 7, wherein said fourth support means comprises a plurality of blocks having substantially vertical slots.

9. The system according to claim 8, wherein said fourth means comprises four blocks having substantially vertical slots located at vertices of said quadrangular sheet.

10. The system according to claim 1, including holding means for preventing disengagement of said second and fourth support means.

11. The system according to claim 10, wherein said holding means comprises a bar attached to said moving means which is movable into a hole in said wrapping head.

12. The system according to claim 10, wherein said wrapping head includes a sheet mounting said fourth support means and said hole is located in said sheet.

13. The system according to claim 1, including pneumatic connection means between said moving machine and said wrapping head.

14. The system according to claim 13, wherein said pneumatic connection means comprises a first joint on said wrapping head which faces downwardly and a second joint on said moving machine which faces upwardly and can couple with said first joint.

15. The system according to claim 1, including an electronic connection means between said moving means and said wrapping head.

16. The system according to claim 15, wherein said electronic connection means comprises a first electronic port on said wrapping head and a second electronic port on said moving machine which can connect with said first electronic port.

17. The system according to claim 1, wherein said support frame includes detection means for detecting said wrapping head when mounted thereon.

18. The system according to claim 17, wherein said detection means comprises a feeler element and an electronic transducer.

* * * * *